US008525756B2

(12) United States Patent
Kwon

(10) Patent No.: US 8,525,756 B2
(45) **Date of Patent: *Sep. 3, 2013**

(54) ORGANIC LIGHT EMITTING DISPLAY AND DRIVING METHOD THEREOF TO CHARACTERIZE PIXEL PARAMETER VALUES

(75) Inventor: Oh-Kyong Kwon, Seoul (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 799 days.

This patent is subject to a terminal disclaimer.

(21) Appl. No.: 12/082,147

(22) Filed: Apr. 8, 2008

(65) Prior Publication Data

US 2008/0252570 A1 Oct. 16, 2008

(30) Foreign Application Priority Data

Apr. 10, 2007 (KR) ..... 10-2007-0035011

(51) Int. Cl.
*G09G 3/30* (2006.01)

(52) U.S. Cl.
USPC ..... 345/76; 345/77; 345/82

(58) Field of Classification Search
USPC ..... 345/76, 77, 82
See application file for complete search history.

(56) References Cited

U.S. PATENT DOCUMENTS

| | | | | |
|---|---|---|---|---|
| 6,911,781 | B2 | 6/2005 | Yamazaki et al. | |
| 7,456,812 | B2 | 11/2008 | Smith et al. | |
| 2005/0179625 | A1* | 8/2005 | Choi et al. | 345/76 |
| 2006/0139264 | A1* | 6/2006 | Choi et al. | 345/76 |
| 2007/0018917 | A1* | 1/2007 | Miyazawa | 345/76 |
| 2008/0001854 | A1* | 1/2008 | Hamer et al. | 345/76 |
| 2008/0036703 | A1* | 2/2008 | Wang et al. | 345/76 |
| 2008/0122759 | A1* | 5/2008 | Levey | 345/78 |
| 2008/0224962 | A1* | 9/2008 | Kasai et al. | 345/76 |
| 2008/0252571 | A1 | 10/2008 | Hente et al. | |

FOREIGN PATENT DOCUMENTS

| | | |
|---|---|---|
| JP | 2004-145257 | 5/2004 |
| JP | 2004-145257 A | 5/2004 |
| JP | 2005-128272 A | 5/2005 |
| JP | 2005-258427 A | 9/2005 |
| JP | 2005-309230 A | 11/2005 |
| JP | 2006-058352 | 3/2006 |
| JP | 2006-058352 A | 3/2006 |
| JP | 2007-052202 | 3/2007 |
| JP | 2007-140325 A | 6/2007 |
| KR | 10-2005-0049320 | 5/2005 |

(Continued)

OTHER PUBLICATIONS

Office Action issued on Aug. 29, 2008 by the Korean Intellectual Property Office in Korean Patent Application No. 10-2007-0035011.

(Continued)

*Primary Examiner* — Kwang-Su Yang
(74) *Attorney, Agent, or Firm* — Knobbe Martens Olson & Bear LLP

(57) ABSTRACT

An organic light emitting display capable of displaying an image with uniform luminance regardless of deterioration of an organic light emitting diode and threshold voltage/mobility of a drive transistor is disclosed. The organic light emitting display senses deterioration of the organic light emitting diode and the threshold voltage and/or mobility of a drive transistor and modifies the data supplied to the pixel according to the sensed parameters.

20 Claims, 6 Drawing Sheets

(56) References Cited

FOREIGN PATENT DOCUMENTS

| | | | |
|---|---|---|---|
| KR | 10-2005-0049320 | A | 5/2005 |
| KR | 10-2005-0052332 | | 6/2005 |
| KR | 10-2005-0052332 | A | 6/2005 |
| KR | 10-2006-0029062 | A | 4/2006 |
| KR | 10-2006-0112993 | | 11/2006 |
| KR | 10-2006-0112993 | A | 11/2006 |
| KR | 10-2006-0132795 | | 12/2006 |
| KR | 10-2006-0132795 | A | 12/2006 |
| KR | 10-2007-0000422 | A | 1/2007 |
| KR | 10-2007-0019882 | A | 2/2007 |

OTHER PUBLICATIONS

Korean Notice of Allowance dated Jun. 26, 2008 for Korean Application No. KR 10-2007-0035009 corresponding to U.S. Appl. No. 12/080,956, filed Apr. 8, 2008, which is related to the captioned application.

Korean Office Action dated Aug. 29, 2008 for Korean Patent Applications No. KR 10-2007-0028166 corresponding to U.S. Appl. No. 12/077,828, filed Mar. 21, 2008, which is related to the captioned application.

Korean Notice of Allowance dated Jun. 26, 2008 for Korean Patent Applications No. KR 10-2007-0035012 corresponding to U.S. Appl. No. 12/080,955, filed Apr. 8, 2008, which is related to the captioned application.

Office Action dated Aug. 17, 2011 for U.S. Appl. No. 12/080,956, filed Apr. 8, 2008, which is related to captioned U.S. Appl. No. 12/082,147.

Office Action dated Aug. 10, 2011 for U.S. Appl. No. 12/077,828, filed Mar. 21, 2008, which is related to captioned U.S. Appl. No. 12/082,147.

Office Action dated Aug. 10, 2011 for U.S. Appl. No. 12/080,955, filed Apr. 8, 2008, which is related to captioned U.S. Appl. No. 12/082,147.

Office Action dated Mar. 28, 2012 for U.S. Appl. No. 12/077,828, filed Mar. 21, 2008, which is related to captioned U.S. Appl. No. 12/082,147.

Office Action dated Apr. 25, 2012 for U.S. Appl. No. 12/080,955, filed Apr. 8, 2008, which is related to captioned U.S. Appl. No. 12/082,147.

Notice of Allowance dated Nov. 5, 2012 for U.S. Appl. No. 12/077,828, filed Mar. 21, 2008, which is related to captioned U.S. Appl. No. 12/082,147.

* cited by examiner

ORGANIC LIGHT EMITTING DISPLAY AND DRIVING METHOD THEREOF TO CHARACTERIZE PIXEL PARAMETER VALUES

CROSS-REFERENCE TO RELATED APPLICATIONS

This application claims the benefit of Korean Patent Application No. 10-2007-0035011, filed on Apr. 10, 2007, in the Korean Intellectual Property Office, the disclosure of which is incorporated herein by reference.

BACKGROUND

1. Field

The field relates to an organic light emitting display and a driving method thereof, and more particularly to an organic light emitting display capable of displaying an image with uniform luminance regardless of deterioration of an organic light emitting diode and threshold voltage or mobility of a drive transistor, and a driving method thereof.

2. Discussion of Related Technology

In recent years, a variety of flat panel displays of reduced weight and volume, when compared to a cathode ray tube have been developed and commercialized. A flat panel display may take the form of a liquid crystal display (LCD), a field emission display (FED), a plasma display panel (PDP), an organic light emitting display (OLED), etc.

Among the flat panel displays, the organic light emitting display uses an organic light emitting diode to display an image, the organic light emitting diode generating light by means of the recombination of electrons and holes. Such an organic light emitting display has advantages in that it has a rapid response time and is also driven with low power consumption.

FIG. 1 is a circuit view showing a pixel of a conventional organic light emitting display.

Referring to FIG. 1, the pixel 4 includes an organic light emitting diode (OLED), data lines (Dm), and a pixel circuit 2 connected to the scan lines (Sn) to control the organic light emitting diode (OLED).

An anode electrode of the organic light emitting diode (OLED) is connected to the pixel circuit 2, and a cathode electrode is connected to the second power source (ELVSS). Such an organic light emitting diode (OLED) generates a predetermined luminance to correspond to an electric current supplied from the pixel circuit 2.

The pixel circuit 2 controls an electric current capacity supplied to the organic light emitting diode (OLED) to correspond to a data signal supplied to the data lines (Dm) when a scan signal is supplied to the scan lines (Sn). For this purpose, the pixel circuit 2 includes a second transistor (M2) connected between the first power source (ELVDD) and the organic light emitting diode (OLED); a first transistor (M1) connected between the second transistor (M2) and the data lines (Dm) and the scan lines (Sn); and a storage capacitor (Cst) connected between a gate electrode and a first electrode of the second transistor (M2).

A gate electrode of the first transistor (M1) is connected to the scan lines (Sn), and a first electrode is connected to the data lines (Dm). A second electrode of the first transistor (M1) is connected to one side terminal of the storage capacitor (Cst). Here, the first electrode is either a source electrode or a drain electrode, and the second electrode is the electrode which is different from the first electrode. For example, if the first electrode is a source electrode, the second electrode is a drain electrode. When a scan signal is supplied from the scan lines (Sn), the first transistor (M1) connected to the scan lines (Sn) and the data lines (Dm) is turned on to supply the data signal from the data lines (Dm) to the storage capacitor (Cst). As a result, the storage capacitor (Cst) charges a voltage corresponding to the data signal.

The gate electrode of the second transistor (M2) is connected to one terminal of the storage capacitor (Cst), and the first electrode is connected to the other terminal of the storage capacitor (Cst) and to the first power source (ELVDD). The second electrode of the second transistor (M2) is connected to the anode electrode of the organic light emitting diode (OLED). The second transistor (M2) controls the electric current so as to correspond to the voltage stored in the storage capacitor (Cst), the electric current flowing from the first power source (ELVDD) to the second power source (ELVSS) via the organic light emitting diode (OLED). In response, the organic light emitting diode (OLED) generates light according to the amount of electric current supplied from the second transistor (M2).

However, an organic light emitting display having a pixel such as that of FIG. 1 has a disadvantage that it is difficult to display an image having a desired luminance due to the changes in current caused by the deterioration of the organic light emitting diode (OLED). The organic light emitting diode deteriorates with the passage of time, and therefore, the organic light emitting diode generates light of reduced luminance over time despite receiving the same level of a data signal. Also, the conventional organic light emitting display has a problem that it does not display an image having a uniform luminance due to non-uniformity in the threshold voltage and/or mobility of the drive transistors (M2) in each of the pixels 4.

SUMMARY OF CERTAIN INVENTIVE ASPECTS

One aspect is an organic light emitting display, including a plurality of pixels, each arranged near intersections of data lines, scan lines, power lines, and light emitting control lines. The display also includes a scan driver configured to supply a scan signal to the scan lines and to supply a light emitting control signal to the light emitting control lines, a control line driver configured to supply a control signal to a plurality of control lines, a data driver configured to generate a data signal for the data lines, and a sensing unit configured to sense information about at least one of an organic light emitting diode, a voltage of a drive transistor, and mobility of the drive transistor for one or more of the pixels. The display also includes a switching unit configured to connect one of the sensing unit and the first power source with the power lines and to connect one of the sensing unit and the data driver with the data lines, a control block configured to store the sensed information, and a timing controller configured to generate the second data based on the sensed information and a first data received from another circuit.

Another aspect is a method of driving an organic light emitting display. The method includes generating a first voltage while supplying an electric current to a drive transistor and an organic light emitting diode, converting the first voltage into a first digital value and storing the first digital value in a memory, generating a second voltage while supplying an electric current to the organic light emitting diode via the data lines, converting the second voltage into a second digital value and storing the second digital value in the memory, and converting a first data supplied from another circuit to a second data based on the first digital value and the second digital value.

BRIEF DESCRIPTION OF THE DRAWINGS

These and/or other aspects and advantages will become apparent and more readily appreciated from the following description of certain inventive embodiments, taken in conjunction with the accompanying drawings of which.

DETAILED DESCRIPTION OF CERTAIN INVENTIVE EMBODIMENTS

Figure 1:
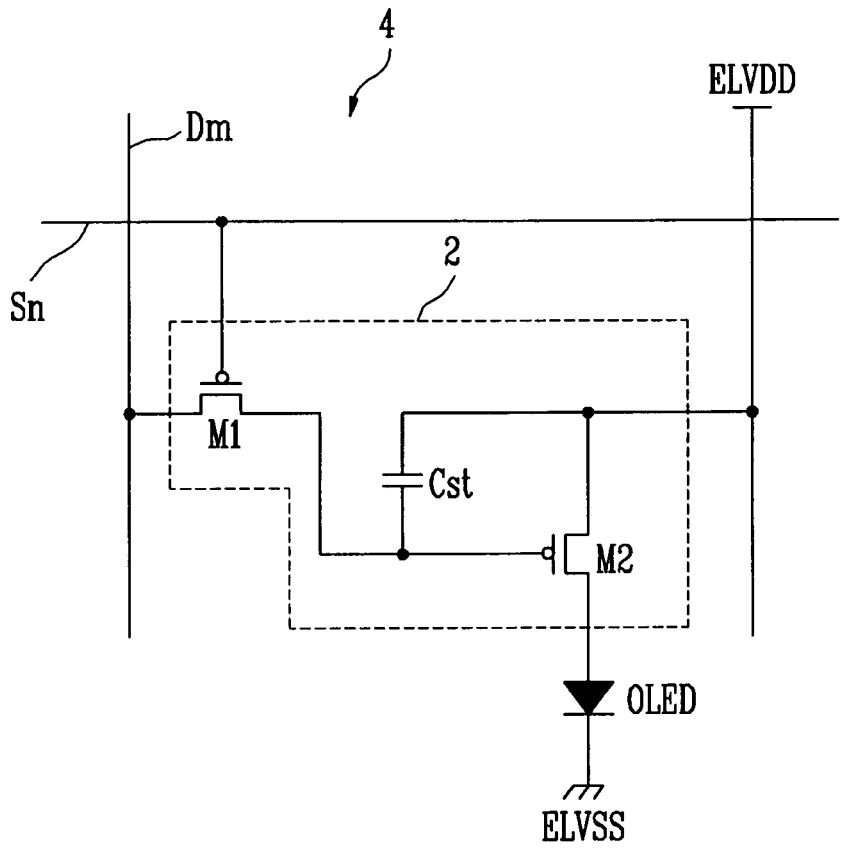
FIG. 1 (PRIOR ART)
FIG. 1 is a circuit view showing pixels of a conventional organic light emitting display.

Hereinafter, certain embodiments will be described with reference to the accompanying drawings. Here, when one element is connected to another element, one element may be not only directly connected to another element but also indirectly connected to another element via a third element. Further, irrelative elements may be omitted for clarity. Also, like reference numerals generally refer to like elements throughout.

Figure 2:
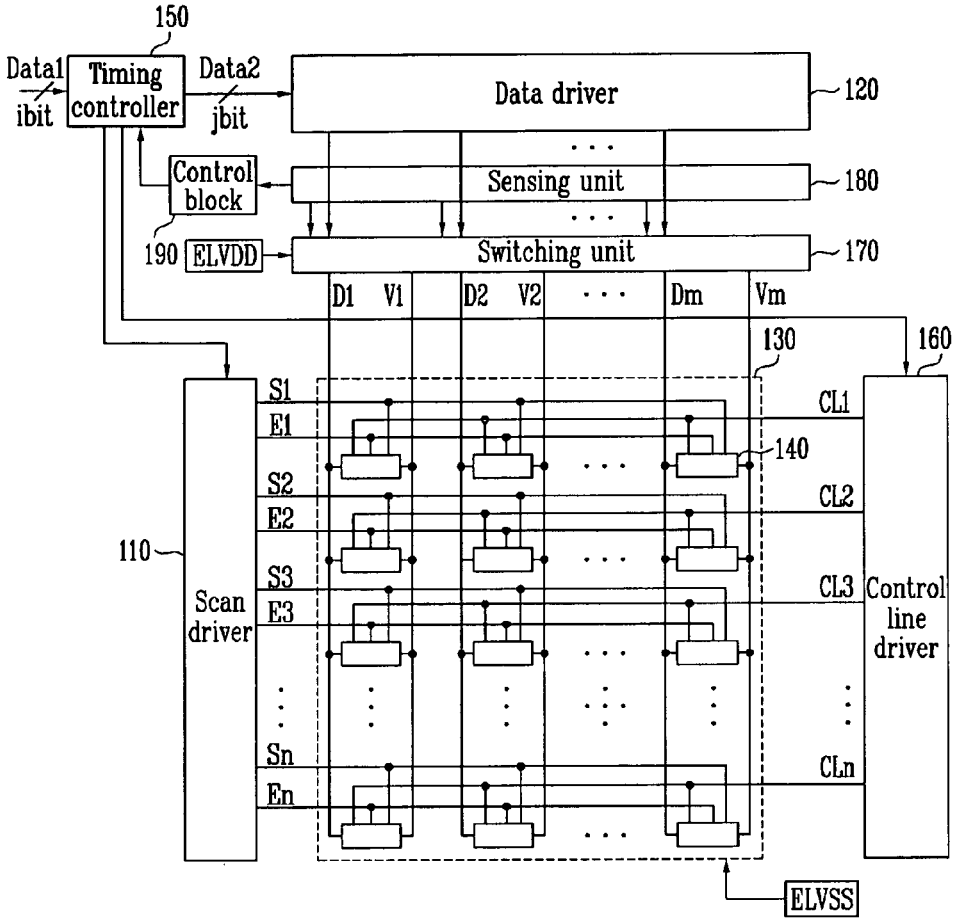
FIG. 2 is a block diagram showing an organic light emitting display according to one embodiment.

FIG. 2 is a diagram showing an organic light emitting display according to one embodiment.

Referring to FIG. 2, an organic light emitting display includes pixels 140 connected to scan lines (S1 to Sn), light emitting control lines (E1 to En) and data lines (D1 to Dm); a scan driver 110 for driving the scan lines (S1 to Sn) and the light emitting control lines (E1 to En); a control line driver 160 for driving control lines (CL1 to CLn); a data driver 120 for driving the data lines (D1 to Dm); and a timing controller 150 for controlling the scan driver 110, the data driver 120, and the control line driver 160.

Also, the organic light emitting display according to one embodiment of the present invention further includes a sensing unit 180 for extracting the information about the deterioration of the organic light emitting diode and the threshold voltage/mobility of the drive transistor, the organic light emitting diode and the drive transistor being included in each of the pixels 140; a switching unit 170 for selectively connecting the sensing unit 180 and the data driver 120 to the data lines (D1 to Dm) and selectively connecting the sensing unit 180 and the first power source (ELVDD) to the power lines (V1 to Vm); and a control block 190 for storing the information sensed in the sensing unit 180.

The pixel unit 130 includes pixels 140 arranged near intersecting points of the scan lines (S1 to Sn), the light emitting control lines (E1 to En), the power lines (V1 to Vm), and the data lines (D1 to Dm). The pixels 140 charge a voltage according to the data signal and supply an electric current corresponding to the charged voltage to the organic light emitting diode, thereby generating light having a desired luminance.

The scan driver 110 supplies a scan signal to the scan lines (S1 to Sn) according to the control of the timing controller 150. Also, the scan driver 110 supplies a light emitting control signal to the light emitting control lines (E1 to En) according to the timing controller 150.

The control line driver 160 supplies a control signal to the control lines (CL1 to CLn) according to the control of the timing controller 150.

The data driver 120 supplies a data signal to the data lines (D1 to Dm) according to the control of the timing controller 150.

The switching unit 170 selectively connects the sensing unit 180 and the first power source (ELVDD) to the power lines (V1 to Vm). When the sensing unit 180 is connected to the power lines (V1 to Vm) by the switching unit 170, information about deterioration of the organic light emitting diode and threshold voltage of the drive transistor are extracted. When the power lines (V1 to Vm) are connected to the first power source (ELVDD) by the switching unit 170, light is generated in the pixel 140, wherein the light corresponds to the data signal.

Also, the switching unit 170 selectively connects the sensing unit 180 and the data driver 120 to the data lines (D1 to Dm). When the sensing unit 180 is connected to the data lines (D1 to Dm) by the switching unit 170, information about deterioration of the organic light emitting diode in the pixel 140 is extracted. When the data lines (D1 to Dm) are connected to the data driver 120 by the switching unit 170, a data signal is supplied to the data lines (D1 to Dm). For this purpose, the switching unit 170 includes at least two switching elements installed in each of the channels.

The sensing unit 180 extracts the information about deterioration of the organic light emitting diode and threshold voltage/mobility of the drive transistor from the pixels 140 via the power lines (V1 to Vm). Furthermore, the sensing unit 180 extracts the information about deterioration of the organic light emitting diode from the pixels 140 via the data lines (D1 to Dm). For this purpose, the sensing unit 180 includes an electric current source unit in each of channels.

The control block 190 stores the information about deterioration and the threshold voltage and/or mobility of the drive transistor supplied from the sensing unit 180. For this purpose, the control block 190 includes a memory; and a controller for transmitting the information stored in the memory to the timing controller 150.

The timing controller 150 controls the data driver 120, the scan driver 110 and the control line driver 160. Also, the timing controller 150 converts a bit value of a first data (Data1) received from another circuit according to the information supplied from the control block 190 to generate a second data (Data2). Here, the first data (Data1) is set to i bits (i is an integer), and the second data (Data2) is set to j bits (j is an integer greater than i).

The second data (Data2) stored in the timing controller 150 is supplied to the data driver 120. The data driver 120 uses the second data (Data2) to generate a data signal and supplies the generated data signal to the pixels 140.

Figure 3:
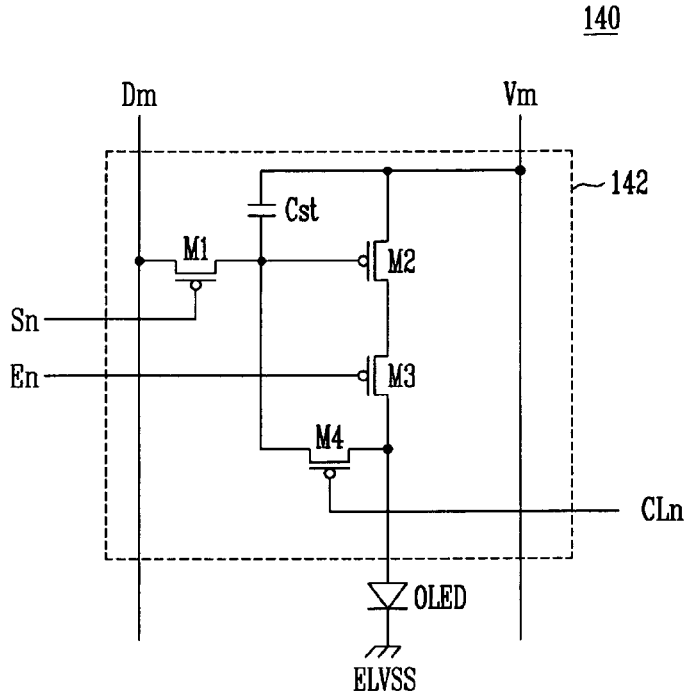
FIG. 3 is a circuit diagram showing one embodiment of the pixels of FIG. 2.

FIG. 3 is a diagram showing one embodiment of the pixels shown in FIG. 2. In FIG. 3, the pixel shown is connected to an $m^{th}$ data line (Dm) and an $n^{th}$ scan line (Sn).

Referring to FIG. 3, the pixel 140 includes an organic light emitting diode (OLED) and a pixel circuit 142 for supplying an electric current to the organic light emitting diode (OLED).

The anode electrode of the organic light emitting diode (OLED) is connected to the pixel circuit 142, and the cathode electrode is connected to the second power source (ELVSS). Such an organic light emitting diode (OLED) generates light having a predetermined luminance to correspond to the electric current supplied from the pixel circuit 142.

The pixel circuit 142 controls the capacity of an electric current flowing in the organic light emitting diode (OLED) to correspond to the voltage stored in the storage capacitor (Cst). The pixel circuit 142 supplies the information about threshold voltage and/or mobility of the drive transistor and deterioration of the organic light emitting diode (OLED) to the sensing unit 180 when the third transistor (M3) and the fourth transistor (M4) are turned on. Further, the pixel circuit 142 supplies the information about deterioration of the organic light emitting diode (OLED) to the sensing unit 180 when the first transistor (M1) and the fourth transistor (M4) are turned on. For this purpose, the pixel circuit 142 includes four transistors (M1 to M4) and a storage capacitor (Cst).

gate electrode of the first transistor (M1) is connected to the scan line (Sn), and a first electrode is connected to the data line (Dm). A second electrode of the first transistor (M1) is connected to a first terminal of the storage capacitor (Cst). The first transistor (M1) is turned on when a scan signal is supplied to the scan line (Sn).

The gate electrode of the second transistor (M2) is connected to a first terminal of the storage capacitor (Cst), and a first electrode is connected to a second terminal and to power line (Vm) of the storage capacitor (Cst). The second transistor (M2) supplies electric current to the organic light emitting diode (OLED), the electric current corresponding to a voltage value stored in the storage capacitor (Cst), when the power line (Vm) is connected to the first power source (ELVDD). Accordingly, the organic light emitting diode (OLED) generates light corresponding to an electric current supplied from the second transistor (M2).

The gate electrode of the third transistor (M3) is connected to the light emitting control line (En), and a first electrode is connected to a second electrode of the second transistor (M2). A second electrode of the third transistor (M3) is connected to the organic light emitting diode (OLED). The third transistor (M3) is turned off when a light emitting control signal is supplied to the light emitting control line (En), and turned on when the light emitting control signal is not supplied to the light emitting control line (En).

The gate electrode of the fourth transistor (M4) is connected to the control line (CLn), and a first electrode is connected to the second electrode of the third transistor (M3). Also, a second electrode of the fourth transistor (M4) is connected to the gate electrode of the second transistor (M2). The fourth transistor (M4) is turned on when the first control signal is supplied.

The storage capacitor (Cst) is connected between the gate electrode and the first electrode of the second transistor (M2). The storage capacitor (Cst) is charged a voltage corresponding to the data signal.

Figure 4:
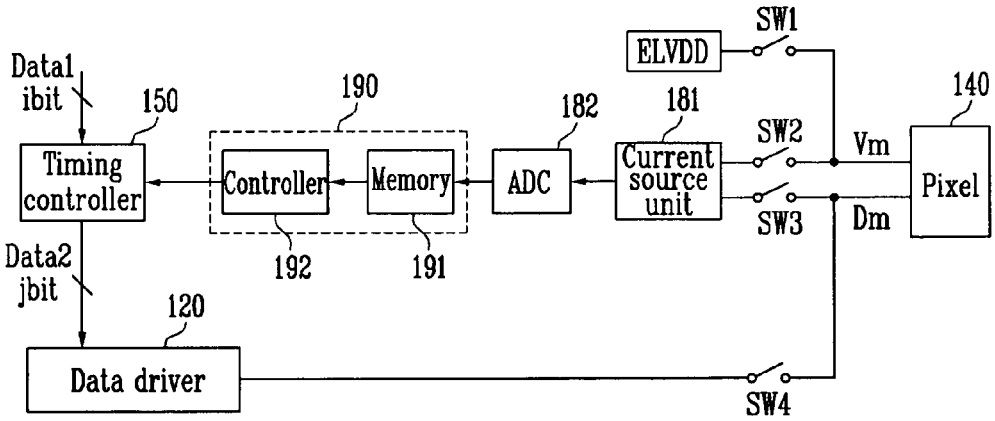
FIG. 4 is a block diagram showing a switching unit, a sensing unit and a control block shown in FIG. 2.

FIG. 4 is a block diagram showing a switching unit, a sensing unit and a control block shown in FIG. 2. In FIG. 4, the switching unit, the sensing unit, and the control block are connected to an $m^{th}$ power line (Vm) and an $m^{th}$ data line (Dm).

Referring to FIG. 4, each of the channels of the switching unit 170 includes four switching elements (SW1 to SW4). Each of the channels of the sensing unit 180 includes an electric current source unit 181 and an analog-digital converter (ADC) 182. One ADC may be shared by one or all of a plurality of channels. The control block 190 includes a memory 191 and a controller 192.

The first switching element (SW1) is between the power line (Vm) and the first power source line (ELVDD). The first switching element (SW1) is maintained in a turned-on state during a period when the light having a luminance corresponding to the data signal is generated in the pixel 140.

The second switching element (SW2) is between the electric current source unit 181 and the power line (Vm). The second switching element (SW2) is turned on when the information about the deterioration of the organic light emitting diode (OLED) and the threshold voltage and/or mobility of the second transistor (M2) are sensed.

The third switching element (SW3) is between the electric current source unit 181 and the data line (Dm). The third switching element (SW3) is turned on when the information about the deterioration of the organic light emitting diode (OLED) is sensed.

The fourth switching element (SW4) is between the data driver 120 and the data line (Dm). The fourth switching element (SW4) is turned on when the data signal is supplied to the data line (Dm).

The electric current source unit 181 senses the information about deterioration of the organic light emitting diode and threshold voltage and/or mobility of the drive transistor while supplying a constant electric current to the power line (Vm) and the data line (Dm). The electric current source unit 181 generates a voltage, and supplies the generated voltage to the ADC 182.

The constant electric current supplied from the electric current source unit 181 to the power line (Vm) is supplied to the second power source (ELVSS) via the second transistor (M2), the third transistor (M3) and the organic light emitting diode (OLED) of the pixel 140. The electric current source unit 181 extracts a first voltage corresponding to the information about threshold voltage and/or mobility of the second transistor (M2) and deterioration of the organic light emitting diode (OLED), and supplies the extracted first voltage to the ADC 182.

The constant electric current supplied from the electric current source unit 181 to the data line (Dm) is supplied to the second power source (ELVSS) via the first transistor (M1), the fourth transistor (M4), and the organic light emitting diode (OLED) of the pixel 140. At this time, the electric current source unit 181 extracts a second voltage corresponding to the information about deterioration of the organic light emitting diode (OLED), and supplies the extracted second voltage to the ADC 182.

The resistance of the organic light emitting diode (OLED) increases as the organic light emitting diode (OLED) deteriorates. Accordingly, when the constant electric current is supplied, the voltage at the organic light emitting diode (OLED) changes according to the deterioration of the organic light emitting diode (OLED). In this case, a level of the deterioration of the organic light emitting diode (OLED) may be determined by sensing the voltage at the organic light emitting diode (OLED) while applying the constant electric current. Also, if the constant electric current is supplied via the second transistor (M2), a voltage is applied to the gate electrode of the second transistor (M2). Here, the threshold voltage and/or mobility of the second transistor (M2) may be determined by applying the voltage to the gate electrode of the second transistor (M2) since the voltage applied to the gate electrode of the second transistor (M2) is determined by the threshold voltage and/or mobility of the second transistor (M2).

The electric current value of the constant electric current supplied to the pixel 140 is experimentally determined so that the information about the threshold voltage and/or mobility of the second transistor (M2) and the deterioration of the organic light emitting diode (OLED) can be extracted from the electric current source unit 181. For example, the constant electric current may be set to an electric current value that will be supplied to the organic light emitting diode (OLED) when the pixel 140 is allowed to emit the light with the highest luminance.

The ADC 182 converts the first voltage supplied to the electric current source unit 181 into a first digital value, and converts the second voltage into a second digital value.

The memory 191 stores the first digital value and the second digital value supplied to the ADC 182. The memory 191 stores the information about the threshold voltage and/or mobility of the second transistor (M2) and the deterioration of the organic light emitting diode (OLED) of each of the pixels 140 in the pixel unit 130. For this purpose, the memory 191 may be a frame memory.

The controller 192 supplies the first digital value and the second digital value to the timing controller 150, wherein the first digital value and the second digital value are extracted from the pixel 140 to which a first data (Data1) will be supplied, the first data (Data1) being received from the current timing controller 150.

The timing controller 150 receives a first data (Data1) and receives the first digital value and the second digital value from the controller 192. After the timing controller 150 receives the first digital value and the second digital value, it converts a bit value of the first data (Data1) to generate a second data (Data2), thereby displaying an image having a uniform luminance.

For example, the timing controller 150 generates a second data (Data2) with reference to the second digital value since the value of the first data (Data1) is increased as the organic light emitting diode (OLED) deteriorates. Accordingly, the second data (Data2) reflects the information about the deterioration of the organic light emitting diode (OLED) and therefore the timing controller 150 prevents the emitted light from having a lower luminance from being generated as the organic light emitting diode (OLED) is deteriorates. Also, the timing controller 150 generates a second data (Data2) to compensate for threshold voltage and/or mobility variation of the second transistor (M2) based on the first digital value. Accordingly, with the timing controller 150 an image may be displayed, which has a uniform luminance regardless of the threshold voltage and/or mobility of the second transistor (M2). Here, the information about the threshold voltage and/or mobility of the second transistor (M2) may be obtained using the second digital value and the first digital value.

The first digital value and the second digital value supplied from the ADC 182 may be supplied to the controller 192. The controller 192 may use the first digital value and the second digital value to generate a new first digital value including only the information about the threshold voltage and/or mobility of the second transistor (M2). The controller 192 stores the second digital value supplied from the ADC 182; and the newly generated first digital value in the memory 191. In this case, the second digital value stored in the memory 191 includes the information about the deterioration of the organic light emitting diode (OLED), and the first digital value includes the information about the threshold voltage and/or mobility of the second transistor (M2), and therefore extracting the information about the threshold voltage and/or mobility of the second transistor (M2) from the timing controller 150 may be omitted.

The data driver 120 uses the second data (Data) to generate a data signal and supplies the generated data signal to the pixel 140.

Figure 5:
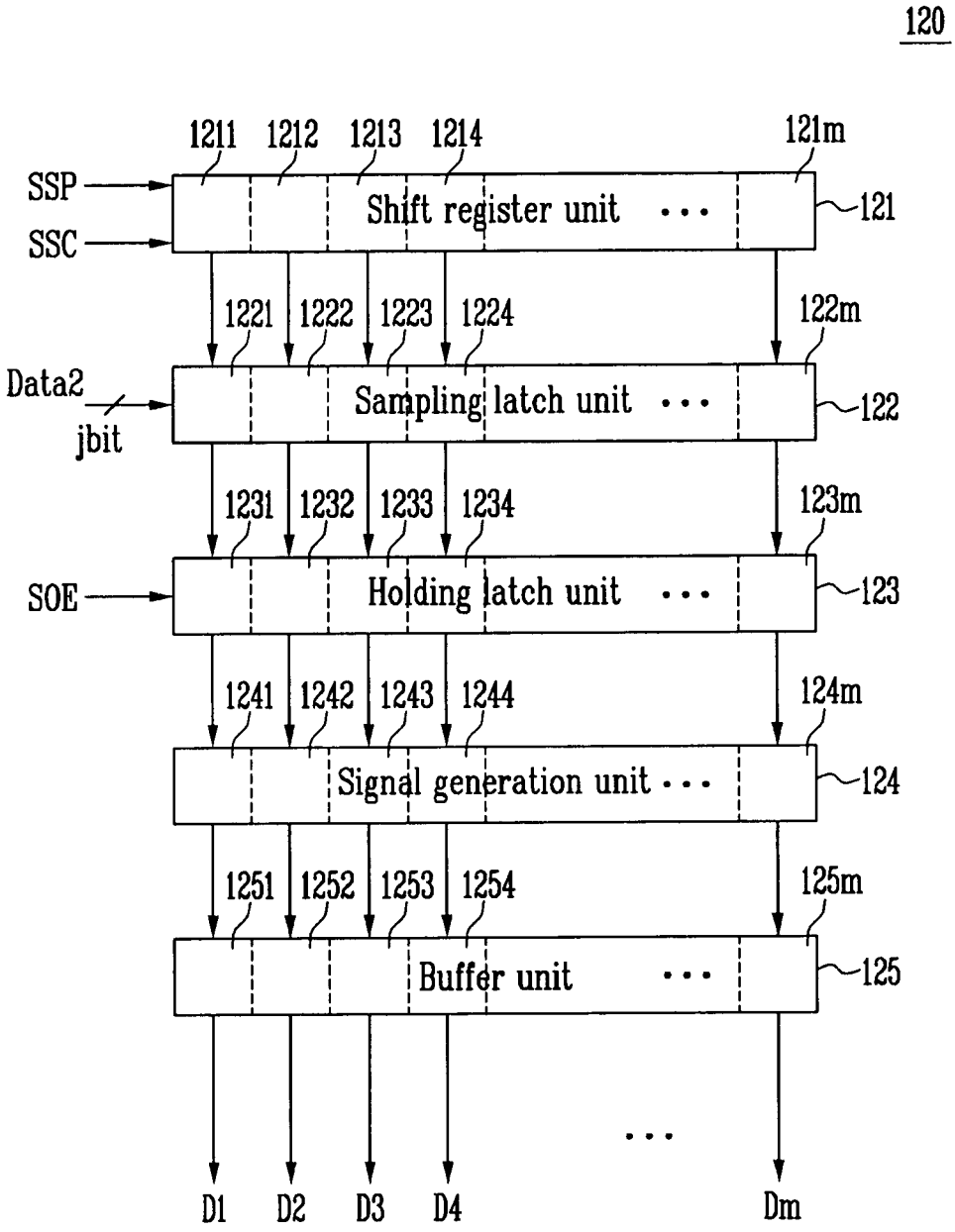
FIG. 5 is a block diagram showing an embodiment of the data driver shown in FIG. 2.

FIG. 5 is a diagram showing one embodiment of a data driver.

Referring to FIG. 5, the data driver includes a shift register unit 121, a sampling latch unit 122, a holding latch unit 123, a signal generation unit 124, and a buffer unit 125.

The shift register unit 121 receives a source start pulse (SSP) and a source shift clock (SSC) from the timing controller 150. The shift register unit 121 receiving the source shift clock (SSC) and the source start pulse (SSP) sequentially generates the sampling signals while shifting the source start pulse (SSP) during each period of the source shift clock (SSC). For this purpose, the shift register unit 121 includes m shift registers (121*l* to 121*m*). In some embodiments, m is greater than 9.

The sampling latch unit 122 sequentially stores the second data (Data2) in response to the sampling signal sequentially supplied from the shift register unit 121. For this purpose, the sampling latch unit 122 includes the m number of sampling latch 122*l* to 122*m* so as to store the m number of the second data (Data2).

The holding latch unit 123 receives a source output enable (SOE) signal from the timing controller 150. The holding latch unit 123 receiving the source output enable (SOE) signal receives a second data (Data2) from the sampling latch unit 122 and stores the received second data (Data2). The holding latch unit 123 supplies the second data (Data2) stored therein to the signal generation unit 124. For this purpose, the holding latch unit 123 includes the m number of holding latches 123*l* to 123*m*.

The signal generation unit 124 receives second data (Data2) from the holding latch unit 123, and generates the m number of data signals according to the received second data (Data2). For this purpose, the signal generation unit 124 includes the m number of digital-analog converters (hereinafter, referred to as a "DAC") 124*l* to 124*m*. That is, the signal generation unit 124 uses the DACs (124*l* to 124*m*), arranged in each channel to generate the m number of data signals and supplies the generated data signals to the buffer unit 125.

The buffer unit 125 supplies the m number of the data signals supplied from the signal generation unit 124 to each of the m number of the data lines (D1 to Dm). For this purpose, the buffer unit 125 includes the m number of buffers (125*l* to 125*m*).

Figure 6A:
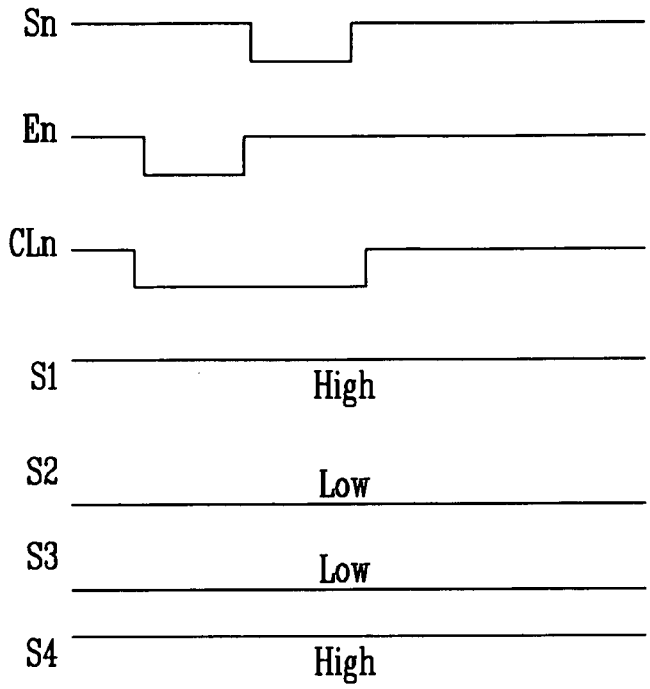
FIG. 6*a* and FIG. 6*b* are waveform views showing a method for driving an organic light emitting display according to one embodiment.
Figure 6B:
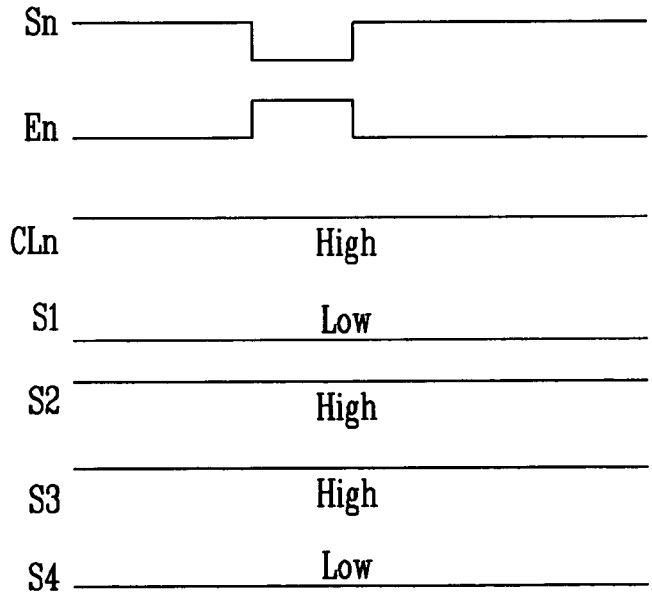

FIG. 6*a* and FIG. 6*b* are diagrams showing a driving waveform supplied to the pixel and the switching unit.

FIG. 6*a* show a waveform view for sensing information about the threshold voltage and/or mobility of the second transistor (M2) and the deterioration of the organic light emitting diode (OLED) in the pixels 140. The second switching element (SW2) and the third switching element (SW3) are maintained in a turned-on state.

Figure 7:
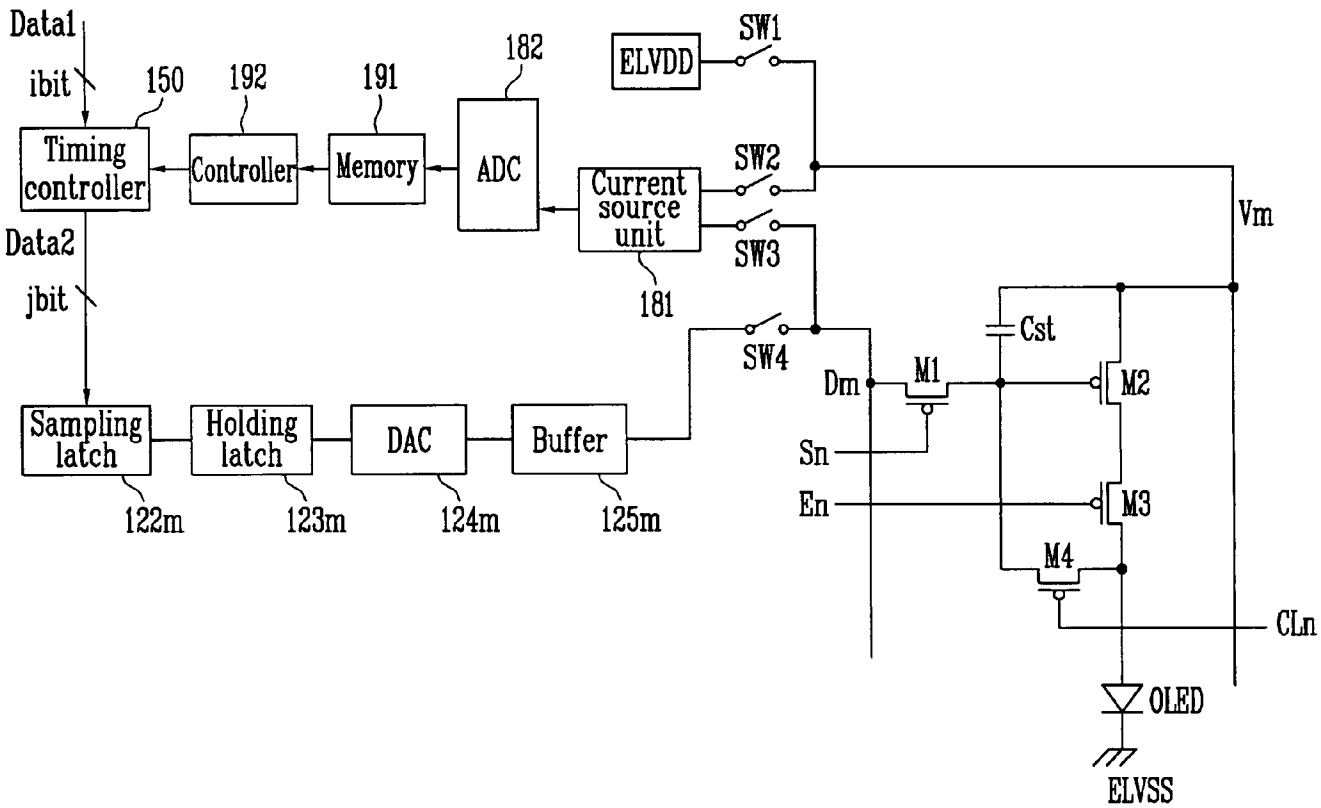
FIG. 7 is a block diagram showing a configuration where a data driver, a timing controller, a control block, a sensing unit, a switching unit and pixels are connected to each other.

An operation of the organic light emitting display will be described in more detail with reference to FIG. 6*a* and FIG. 7. First, when a control signal is supplied to the control line (CL1*n*), the fourth transistor (M4) is turned on. Also, the third transistor (M3) is turned on since a light emitting control signal is not supplied to the light emitting control line (En).

When the fourth transistor (M4) and third transistor (M3) are turned on, the second transistor (M2) is connected in a diode configuration. As a result, an electric current is supplied from the electric current source unit 181 to the second power source (ELVSS) through the second transistor (M2), the third transistor (M3), and the organic light emitting diode (OLED). As a result, a first voltage is generated according to the electric current flowing in the electric current source unit 181. For example, the first voltage is the result of a combination of the threshold and/or mobility of the second transistor (M2) and the resistance of the organic light emitting diode (OLED), showing the deterioration thereof. As described above, the first voltage applied to the electric current source unit 181 is converted into a first digital value in the ADC 182, and the converted first digital value is then supplied to the memory 191.

To characterize the organic light emitting diode (OLED) without the second transistor (M2) the third transistor (M3) is turned off when the light emitting control signal is supplied to the light emitting control line (En), and the first transistor (M1) is also turned on when the scan signal is supplied to the scan line (Sn).

When the first transistor (M1) is turned on, the constant electric current supplied from the electric current source unit 181 is supplied to the second power source (ELVSS) through the first transistor (M1), the fourth transistor (M4), and the organic light emitting diode (OLED). As a result, a second voltage is generated according to the constant electric current flowing in the electric current source unit 181 applied to the organic light emitting diode (OLED). The second voltage applied to the electric current source unit 181 is converted into a second digital value in the ADC 182, and the converted second digital value is supplied to the memory 191.

The first digital value and the second digital value corresponding to each of all the pixels 140 are stored in the memory 191 through the aforementioned procedures. The procedure of sensing the information about the threshold voltage and/or mobility of the second transistor (M2) and the deterioration of the organic light emitting diode (OLED) may be carried out, for example, whenever power is supplied to the organic light emitting display.

The first digital value and the second digital value generated in the ADC 182 may be supplied to the controller 192. In this case, the controller 192 converts the first digital value so that it can have the information about the threshold voltage and/or mobility of the second transistor (M2), and then stores the converted first digital value in the memory 191.

FIG. 6*b* shows a waveform view for carrying out a normal display operation. During a normal display period, the scan driver 110 sequentially supplies a scan signal to the scan lines (S1 to Sn), and sequentially supplies a light emitting control signal to the light emitting control lines (E1 to En). The first switching element (SW1) and the fourth switching element (SW4) are maintained in a turned-on state during the normal display period. Also, the fourth transistor (M4) is maintained in a turned-off state during the normal display period.

An operation of the organic light emitting display will be described in more detail with reference to FIG. 6*b* and FIG. 7. First, a first data (Data1) is supplied to the timing controller 150. The controller 192 supplies a first digital value and a second digital value to the timing controller 150, the first digital value and the second digital value being extracted from the pixel 140 connected with the data line (Dm) and the scan line (Sn), as described above.

The timing controller 150 receiving the first digital value and the second digital value converts the first data (Data1) to generate a second data (Data2). The second data (Data2) is set to compensate for the deterioration of the organic light emitting diode (OLED) and the threshold voltage and/or mobility of the second transistor (M2).

For example, a "00001110" may be the first data (Data1). The timing controller 150 may generate "000011110" as the second data (Data2) to compensate for the deterioration of the organic light emitting diode (OLED) and/or a shift in the threshold voltage and/or mobility of the second transistor (M2).

The second data (Data2) generated in the timing controller 150 is supplied to a DAC 124*m* via a sampling latch 122*m* and a holding latch 123*m*. The DAC 124*m* then uses the second data (Data2) to generate a data signal and supplies the generated data signal to the data line (Dm) via a buffer 125*m*.

Because the first transistor (M1) is turned on if the scan signal is supplied to the scan line (Sn), the data signal supplied to the data line (Dm) is supplied to the gate electrode of the second transistor (M2). The storage capacitor (Cst) is charged with a voltage corresponding to a difference between the first power source (ELVDD) and the data signal supplied to the power line (Vm).

Meanwhile, because the scan signal is supplied to the scan line (Sn) and the light emitting control signal is supplied to the light emitting control line (En) at the same time, unnecessary electric current is not supplied to the organic light emitting diode (OLED) during a period when the voltage corresponding to the data signal is charged in the storage capacitor (Cst).

Then, the first transistor (M1) is turned off when the supply of the scan signal is suspended, and the third transistor (M3) is turned on when the supply of the light emitting control signal is suspended. The second transistor (M2) controls the electric current to correspond to the voltage charged in the storage capacitor (Cst), the electric current flowing from the first power source (ELVDD) to the second power source (ELVSS) through the second transistor (M2), the third transistor (M3) and the organic light emitting diode (OLED). Then, the organic light emitting diode (OLED) generates light having a luminance corresponding to the supplied electric current. The electric current supplied to the organic light emitting diode (OLED) is set to compensate for the deterioration of the organic light emitting diode (OLED) and the threshold voltage and/or mobility of the second transistor (M2), and therefore the electric current may be used to uniformly display an image having a desired luminance.

The pixel 140 as shown in FIG. 3 is provided with PMOS transistors, but the present invention is not limited thereto. The pixels 140 in FIG. 3 may be configured with NMOS transistors. In this case, polarity of a driving waveform of the NMOS transistors is set to a polarity that is opposite to the polarity of the PNMOS transistors, as is well known in the art.

As described above, the organic light emitting display and the driving method thereof stores information about the threshold voltage and/or mobility of the drive transistor and the deterioration of the organic light emitting diode in a memory. The organic light emitting display generates a second data to compensate for the deterioration of the organic light emitting diode and the threshold voltage and/or mobility of the drive transistor using the information stored in the memory, and supplies the generated second data signal to the pixels. As a result, the organic light emitting display displays an image having a uniform luminance regardless of the deterioration of the organic light emitting diode and the threshold voltage and/or mobility of the drive transistor.

The description herein discloses certain example embodiments for the purpose of illustrations only, and the invention is not intended to be limited to these embodiments, so it should be understood that other equivalents and modifications could be made.

What is claimed is:

1. An organic light emitting display, comprising:

a plurality of pixels, each arranged near intersections of data lines, scan lines, power lines, and light emitting control lines;

a scan driver configured to supply a scan signal to the scan lines and to supply a light emitting control signal to the light emitting control lines;

a control line driver configured to supply a control signal to a plurality of control lines;

a data driver configured to generate a data signal for the data lines;

a sensing unit configured to sense an information about at least one of deterioration of an organic light emitting diode, a threshold voltage of a drive transistor, and a mobility of the drive transistor for one or more of the pixels;

a switching unit configured to selectively connect either of the sensing unit and a first power source with the power lines and to selectively connect either of the sensing unit and the data driver with the data lines, wherein while the sensing unit is connected with the power lines, the first power source is not connected with the power lines, and wherein while the sensing unit is connected with the data lines, the data driver is not connected with the data lines;

a control block configured to store the sensed information; and a timing controller configured to generate a second data based on the sensed information and a first data received from another circuit, wherein the sensing unit comprises:

an electric current source unit located in each of a plurality of channels, and an analog-digital converter configured to convert the sensed information about the deterioration of the organic light emitting diode and the threshold voltage and/or the mobility of the drive transistor into a first digital value and to convert the information about the deterioration of the organic light emitting diode into a second digital value, and wherein the switching unit includes four switching elements in every channel, wherein the four switching elements comprise:

a first switching element located between the first power source and a selected one of the power lines, the first switching element configured to be turned on when the first power source is supplied to the selected power line;

a second switching element located between the electric current source unit and the selected the power line, the second switching element configured to be turned on when the information about the threshold voltage and/or the mobility of the drive transistor and the deterioration of the organic light emitting diode are sensed;

a third switching element located between the electric current source unit and the data line, the third switching element configured to be turned on when the information about the deterioration of the organic light emitting diode is sensed; and a fourth switching element located between the data driver and the data line, the fourth switching element configured to be turned on when the data signal is supplied to the data lines.

2. The organic light emitting display according to claim 1, wherein the control block comprises:

a memory configured to store the first digital value and the second digital value; and a controller configured to transmit the first digital value and the second digital value to the timing controller.

3. The organic light emitting display according to claim 2, wherein the controller is configured to supply the first digital value and the second digital value to the timing controller when the first data is input to the timing controller.

4. The organic light emitting display according to claim 3, wherein the timing controller is configured to generate the second data using the first digital value and the second digital value and the second data has more bits than the first data.

5. The organic light emitting display according to claim 4, wherein the second data has a value which compensates for at least one of the deterioration of the organic light emitting diode, a threshold voltage variation of the drive transistor, and a mobility variation of the drive transistor.

6. The organic light emitting display according to claim 4, wherein the data driver comprises:

a shift register unit configured to sequentially generate a sampling signal;

a sampling latch unit configured to sequentially store the second data according to the sampling signal;

a holding latch unit configured to temporarily store the second data stored in the sampling latch unit;

a signal generation unit configured to generate data signals using the second data stored in the holding latch unit; and a buffer unit configured to transmit the data signals to the data lines.

7. The organic light emitting display according to claim 2, wherein each of the pixels comprises:

an organic light emitting diode;

a first transistor connected to the scan lines and the data lines and turned on when a scan signal is supplied to the scan lines;

a storage capacitor configured to be charged with a voltage corresponding to the data signal supplied to the data lines;

the drive transistor configured to supply an electric current to the organic light emitting diode according to the voltage stored in the storage capacitor;

a third transistor between the drive transistor and the organic light emitting diode, the third transistor configured to be turned off when a light emitting control signal is supplied to the light emitting control line; and a fourth transistor connected between a gate electrode of the drive transistor and an anode electrode of the organic light emitting diode, the fourth transistor configured to be turned on when a control signal is supplied to the control line.

8. The organic light emitting display according to claim 7, wherein, when the information about the threshold voltage and/or the mobility of the drive transistor and the deterioration of the organic light emitting diode are sensed, the third transistor and the fourth transistor are configured to be turned on to allow a constant electric current to flow through the drive transistor and the organic light emitting diode, the constant electric current being supplied from the electric current source unit to the power lines.

9. The organic light emitting display according to claim 8, wherein a first voltage, generated when the constant electric current flows in the drive transistor and the organic light emitting diode, is converted into the first digital value.

10. The organic light emitting display according to claim 8, wherein, when the information about the deterioration of the organic light emitting diode is sensed, the first transistor and the fourth transistor are configured to be turned on to allow the constant electric current supplied from the electric current source unit to flow through the organic light emitting diode.

11. The organic light emitting display according to claim 10, wherein the second voltage generated when the constant electric current flows in the organic light emitting diode is converted into the second digital value.

12. The organic light emitting display according to claim 11, wherein the first digital value and the second digital value are generated when a power source is supplied to the organic light emitting display.

13. The organic light emitting display according to claim 7, wherein the fourth transistor is maintained in a turned-off state during a period when a data signal is supplied to the storage capacitor and during a period when light is generated in the organic light emitting diode.

14. The organic light emitting display according to claim 1, wherein the control block comprises:

a controller configured to generate a third digital value having only the information about at least one of the threshold voltage and the mobility of the drive transistor using the first digital value and the second digital value; and a memory configured to store the second digital value and the third digital value.

15. The organic light emitting display according to claim 14, wherein the timing controller is configured to generate the second data using the second digital value and the third digital value, wherein the second data comprises more bits than the first data.

16. The organic light emitting display according to claim 15, wherein the second data has a value which compensates for at least one of the deterioration of the organic light emitting diode, the threshold voltage variation of the drive transistor, and the mobility of the drive transistor.

17. A method of driving an organic light emitting display, the method comprising:

generating a first voltage while supplying an electric current through a drive transistor and through an organic light emitting diode;

converting the first voltage into a first digital value and storing the first digital value in a memory;

generating a second voltage while supplying another electric current to the organic light emitting diode via the data lines;

converting the second voltage into a second digital value and storing the second digital value in the memory; and converting a first data supplied from another circuit to a second data based on the first digital value and the second digital value.

18. The method of driving an organic light emitting display according to claim 17, wherein the second data is generated by modifying the value of the first data according to at least one of a threshold voltage variation of the drive transistor, a mobility variation of the drive transistor, and a deterioration of the organic light emitting diode.

19. The method of driving an organic light emitting display according to claim 17, further comprising:

generating a data signal using the second data; and supplying the data signal to one of the pixels to generate light.

20. The method of driving an organic light emitting display according to claim 17, wherein the first digital value and the second digital value are generated when a power source is supplied to the organic light emitting display.

* * * * *